US006672118B1

(12) United States Patent
Wright

(10) Patent No.: US 6,672,118 B1
(45) Date of Patent: Jan. 6, 2004

(54) APPARATUS AND METHOD FOR RETAINING KEYS

(76) Inventor: Edward E. Wright, 492 S. 1000 East, Orem, UT (US) 84097

( * ) Notice: Subject to any disclaimer, the term of this patent is extended or adjusted under 35 U.S.C. 154(b) by 0 days.

(21) Appl. No.: 10/191,905

(22) Filed: Jul. 8, 2002

(51) Int. Cl.[7] ..... A44B 15/00

(52) U.S. Cl. ..... 70/459; 70/456 R; 206/37.3; 24/3.6

(58) Field of Search ..... 70/456 R, 459, 70/457, 458; 206/37.3; 24/3.6; 40/634, 330, 334

(56) References Cited

U.S. PATENT DOCUMENTS

| | | | | | |
|---|---|---|---|---|---|
| 2,071,757 | A | | 3/1937 | Matthews | |
| 2,316,655 | A | * | 4/1943 | Voos | 70/456 R |
| D166,064 | S | * | 3/1952 | Blecher | D8/100 |
| 2,694,244 | A | * | 11/1954 | Nolan | 70/457 |
| 2,846,866 | A | * | 8/1958 | Hill | 70/456 R |
| 3,587,262 | A | * | 6/1971 | Kaye | 70/456 R |
| 3,682,216 | A | | 8/1972 | Nelson | |
| 3,978,902 | A | | 9/1976 | Adkison | |
| 4,905,878 | A | * | 3/1990 | Lovinger et al. | 70/456 R |
| 4,939,917 | A | * | 7/1990 | Cartwright | 70/456 R |
| 5,046,343 | A | | 9/1991 | Miwa | |
| 5,310,101 | A | * | 5/1994 | Park et al. | 70/456 R |
| 5,367,896 | A | | 11/1994 | Sundberg | |
| 5,617,751 | A | | 4/1997 | Song | |
| 5,794,768 | A | | 8/1998 | Skeffington et al. | |
| 5,836,187 | A | * | 11/1998 | Janssen et al. | 70/252 |
| 5,842,365 | A | | 12/1998 | Bordonaro | |
| 5,933,922 | A | | 8/1999 | Ochsman | |
| 5,934,123 | A | * | 8/1999 | Eldredge | 70/456 R |
| 6,237,756 | B1 | | 5/2001 | Caudle | |
| 6,260,749 | B1 | | 7/2001 | Horovitz | |
| 6,290,112 | B1 | * | 9/2001 | Iver | 24/3.6 |
| 6,318,610 | B1 | | 11/2001 | Doherty | |
| 6,460,386 | B1 | * | 10/2002 | Watanuki et al. | 70/456 R |

FOREIGN PATENT DOCUMENTS

| | | | | |
|---|---|---|---|---|
| GB | 2084453 A | * | 4/1982 | A47G/29/10 |

* cited by examiner

*Primary Examiner*—Anthony Knight
*Assistant Examiner*—Christopher Boswell
(74) *Attorney, Agent, or Firm*—Wright Law Group, PLLC; Mark F. Wright

(57) ABSTRACT

According to the preferred embodiments of the present invention, an apparatus and method for retaining keys is disclosed. The present invention provides a tensioning mechanism within the body of the key-retaining apparatus for "pinching" the shaft of a key when the shaft is inserted into the body of the key-retaining apparatus. The tensioning mechanism may take the form of a spring-loaded mechanism or a tensioned piece of metal that is selectively pressured against the shaft of the key when the key is inserted into the body of the key-retaining apparatus. Additionally, a thong or strap may be provided for securing the key-retaining apparatus to a purse, backpack, etc.

19 Claims, 5 Drawing Sheets

APPARATUS AND METHOD FOR RETAINING KEYS

BACKGROUND OF THE INVENTION

1. Technical Field

The present invention relates retaining devices and more specifically relates to quickly and easily retrieving keys from a purse or the like.

2. Background Art

In today's society, the use of keys to secure locks for items of value is well known. Almost all adults, and most adolescents as well, maintain one or more keys to lock and unlock various security devices on homes, cars, school lockers, etc. Typically, these various keys are placed on a key ring and/or key fob to help individuals keep track of their various keys. In spite of this, many people, especially women, have a difficult time keeping track of their keys. In many cases, this is because women will keep their key ring in their purse, along with a number of other items. Because of the size of the purse, and the often significant quantity of other items contained therein, some women spend quite a lot of time searching through their purse in an often vain attempt to locate their keys.

A similar problem has been noted when a key ring is dropped into a backpack, satchel, or other carrying device with a relatively voluminous interior that also contains other items. Depending on the size of the container, and the number and size of objects contained therein, it may be very difficult to locate the keys. Additionally, in some circumstances, once a key or set of keys has been deposited in a purse or backpack, it can be difficult to find because the lack of light in some environments makes it difficult to peer inside the purse or backpack and quickly and easily locate the key or keys. In all of these situations and other similar situations, there is a high degree of probability that the keys will be difficult to find and consume precious minutes in a sometimes frustrating search.

In order to address this situation, a number of products have been developed in an attempt to make it easier for people to locate their keys. Some of these devices are magnetic in nature and provide magnets for securing the keys in a specific location inside the purse or satchel. While useful, some keys are non-magnetic and don't work with magnetic key devices. Additionally, it is too easy to dislodge the keys by accidentally bumping the keys with other items that may be inserted into the purse. Other attempts to alleviate the "lost-keys-in-the-purse" syndrome include various types of retractable leashes or ropes that are attached to the keys or key ring, making it impossible to lose the keys in the depths of the purse. However, these devices are problematic in that they also make it very difficult to take the keys or key ring anywhere without removing the keys from the lease or rope. This can be a challenge for individuals with limited dexterity and a time-consuming process as well.

While these various devices have found some limited acceptance, none of these previous devices have made any significant progress in solving the underlying problem of losing keys or a key ring in a purse, backpack, satchel, or the like. Accordingly, without an improved device for providing quick and easy access to keys or key rings in a purse, backpack, satchel, or the like, frustration and unnecessary searching will continue to be the order of the day.

DISCLOSURE OF INVENTION

According to the preferred embodiments of the present invention, an apparatus and method for retaining keys is disclosed. The present invention provides a tensioning mechanism within the body of the key-retaining apparatus for "pinching" the shaft of a key when the shaft is inserted into the body of the key-retaining apparatus. The tensioning mechanism may take the form of a spring-loaded mechanism or a tensioned piece of metal that is selectively pressured against the shaft of the key when the key is inserted into the body of the key-retaining apparatus. Additionally, a thong or strap may be provided for securing the key-retaining apparatus to a purse, backpack, satchel, etc.

BRIEF DESCRIPTION OF DRAWINGS

The preferred embodiments of the present invention will hereinafter be described in conjunction with the appended drawings, wherein like designations denote like elements.

DETAILED DESCRIPTION OF THE DRAWINGS

According to the preferred embodiments of the present invention, an apparatus and method for retaining keys is disclosed. The present invention provides a tensioning mechanism within the body of the key-retaining apparatus for "pinching" at least a portion of a key when the shaft is inserted into the body of the key-retaining apparatus. The tensioning mechanism may take the form of a spring-loaded mechanism or a tensioned piece of metal that is selectively pressured against the shaft of the key when the key is inserted into the body of the key-retaining apparatus.

Additionally, a thong or strap is provided for securing the key-retaining apparatus to a purse, backpack, etc.

Figure 1:
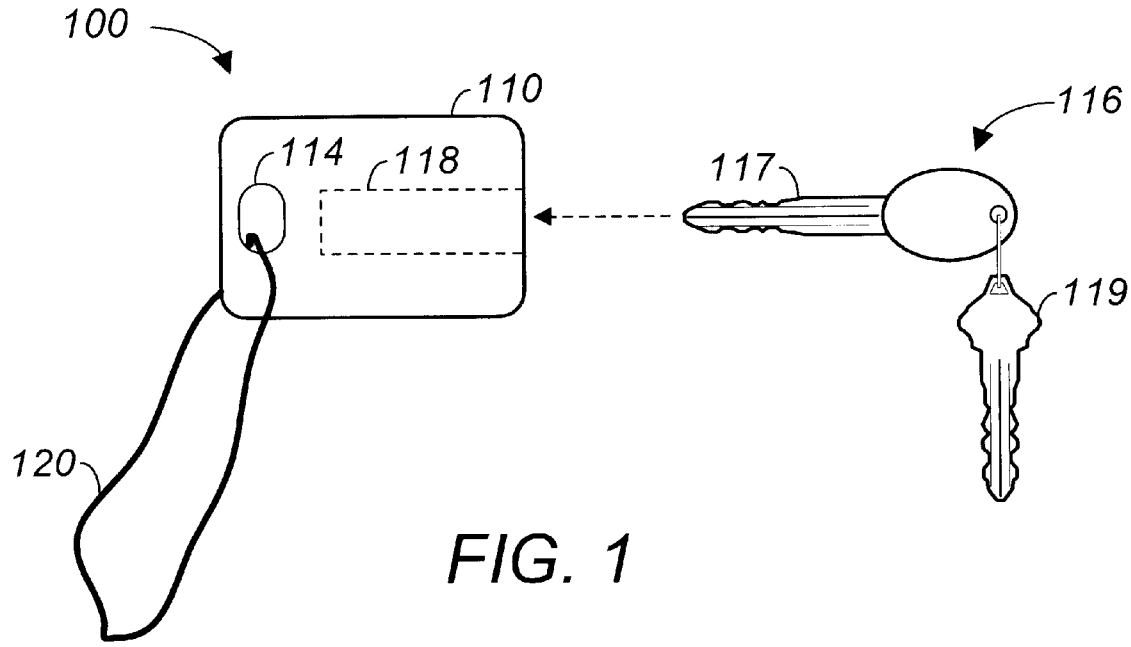
FIG. 1 is a representation of a key-holding apparatus according to a preferred exemplary embodiment of the present invention.

Referring now to FIG. 1, a key-holding apparatus 100 according to a preferred embodiment of the present invention is shown. Key-holding apparatus 100 comprises a body portion 110, a key-receiving portion 118, a body aperture 114, and a retaining strap 120. As shown in FIG. 1, key-receiving portion 118 is an aperture within body portion 110 that is sized and positioned to receive a key 116 by inserting shaft 117 of key 116 into key receiving portion 118.

In the most preferred embodiments of the present invention, body portion 110 is fabricated from an inexpensive hard, durable plastic material and is manufactured by any standard plastics manufacturing process including injection molding. Body portion 110 may be fabricated in one or more pieces and assembled after the discrete components are fabricated. Key 116 may be attached to a key ring with other keys 119.

Body aperture 114 is an opening in body portion 110 and used to attach retaining strap 120 to body portion 110. Body aperture 114 may be formed during the manufacturing process used to fabricate body portion 110 or in a subsequent manufacturing process.

Retaining strap 120 provides a means for attaching key-holding apparatus 100 to a purse strap, backpack strap, satchel handle and the like. By wrapping retaining strap 120 around a purse strap and then body portion 110 of sliding key-holding apparatus 100 through retaining strap 120, key-holding apparatus 100 can be attached to another object. Retaining strap 120 may be fabricated from any suitable material including but not limited to leather, plastic and the like.

Figure 2:
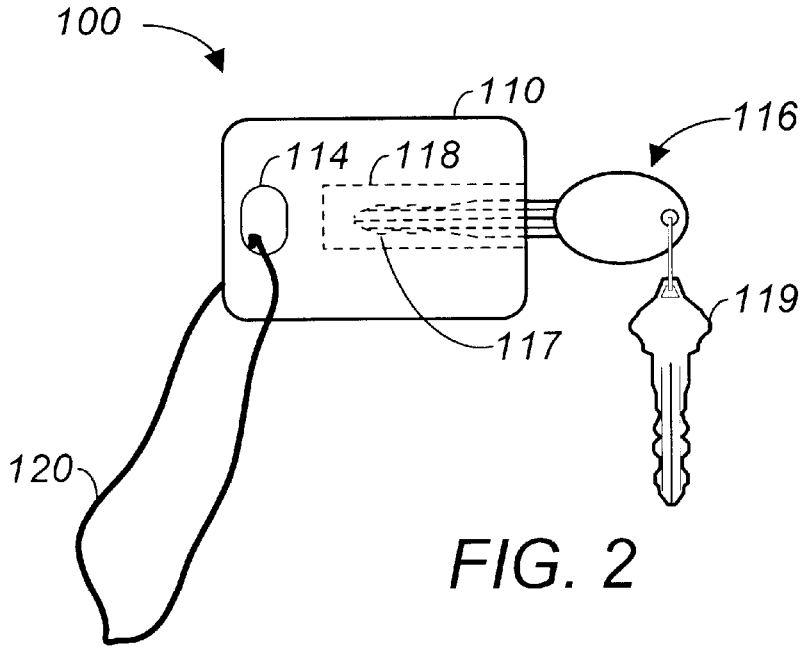
FIG. 2 is the key-holding apparatus of FIG. 1 with a key inserted into the body of the key-holding apparatus.

Referring now to FIG. 2, key-holding apparatus 100 of FIG. 1 is shown with key 116 inserted into key-receiving portion 118. As shown in FIG. 2, a substantial portion of shaft 117 of key 116 has been inserted into key insertion portion 118. While the depth of the insertion may vary based on the exact size and shape of key 116 and the size of key-receiving portion 118, key-receiving portion 118 is preferably sized to accommodate most standard sized keys. The detailed operation of the key-retaining mechanism housed within key-receiving portion 118 is further described in conjunction with FIGS. 3–7.

Figure 3:
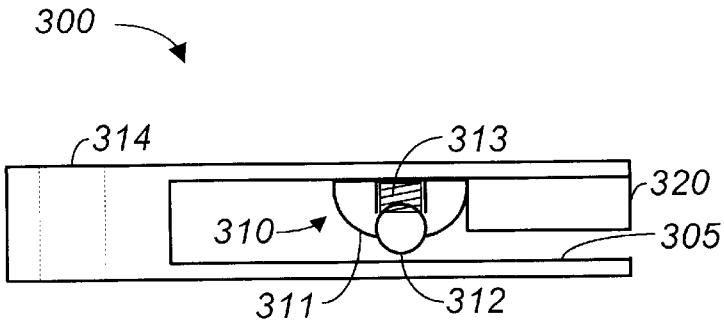
FIG. 3 is a sectional view of the interior of a key-holding apparatus in accordance with a preferred embodiment of the present invention.

Referring now to FIG. 3, a key-holding apparatus 300 in accordance with a preferred embodiment of the present invention is shown. Key-holding mechanism 300 comprises a tensioning mechanism 310, a key blocking portion 320, a floor portion 305 and a body aperture 314. Body aperture 314 is an aperture formed in the body of key-holding apparatus 300 and is designed to receive a strap or leash. Key blocking portion 320 is most preferably an integral pat of key-holding mechanism 300 but may also be a discrete component added after key-holding mechanism 300 is fabricated.

Tensioning mechanism 310 comprises a housing 311, a spring 313 contained within housing 311, and a ball-bearing 312 contained within housing 311. Ball-bearing 312 is pressed towards an opening in housing 311 and towards floor portion 305 by spring 313. Spring 313 is tensioned to urge and otherwise press ball-bearing 312 against a key that is inserted into key-holding apparatus 300.

Figure 4:
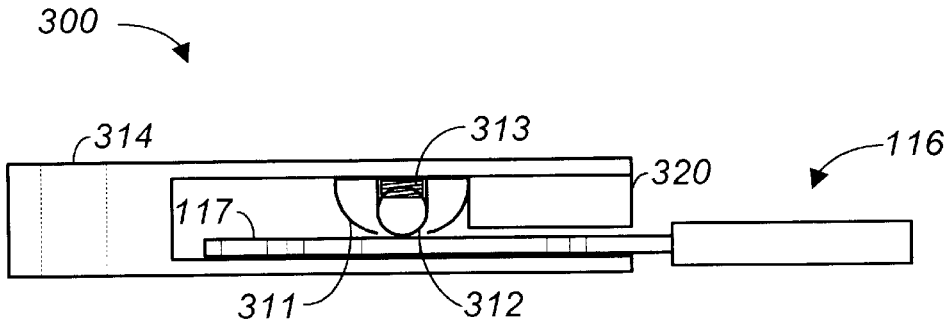
FIG. 4 is a sectional view of the interior of the key-holding apparatus of FIG. 3 with a key inserted into the body of the key-holding apparatus.

Referring now to FIG. 4, key-holding apparatus 300 of FIG. 3 is shown operating in conjunction with a key 116. When shaft 117 of key 116 is inserted into key-holding apparatus 300, ball-bearing 312 engages shaft 117 and shaft 117 is pressed towards an towards floor portion 305 by the combination of ball-bearing 312 and spring 313. Key blocking portion 320 is sized and positioned to prevent shaft portion 117 of key 116 from entering key-holding apparatus 300 above tensioning mechanism 310, thereby ensuring that shaft portion 117 of key 116 engages ball-bearing 312 of tensioning mechanism 310.

Figure 5:
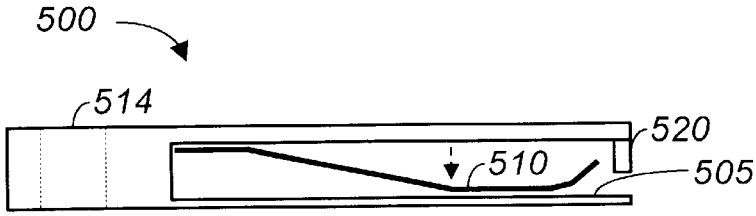
FIG. 5 is a sectional view of the interior of a key-holding apparatus in accordance with an alternative preferred exemplary embodiment of the present invention.

Referring now to FIG. 5,a key-holding apparatus 500 in accordance with an alternative preferred embodiment of the present invention is shown. Key-holding apparatus 500 comprises a tensioning mechanism 510, a key blocking portion 520, a floor portion 505 and a body aperture 514. Body aperture 514 is an aperture formed in the body of key-holding apparatus 500 and is designed to receive a strap or leash. Tensioning mechanism 510 is preferably fabricated from a metal or metallic substance that is durable yet relatively resilient.

Figure 6:
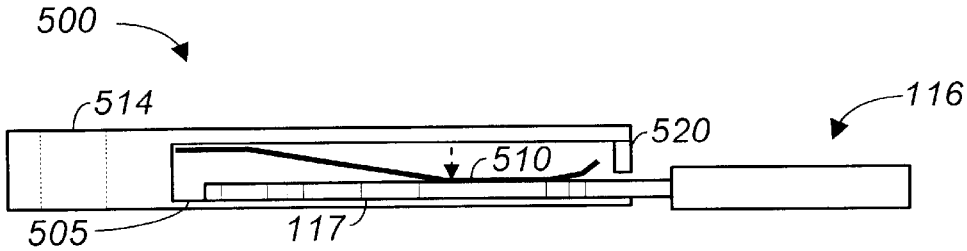
FIG. 6 is a sectional view of the interior of the key-holding apparatus of FIG. 5 with a key inserted into the body of the key-holding apparatus.

Referring now to FIG. 6, key-holding apparatus 500 of FIG. 5 is shown operating in conjunction with a key 116. When shaft 117 of key 116 is inserted into key-holding apparatus 500, shaft portion 117 engages tensioning mechanism 510 and shaft 117 is "pinched" between tensioning mechanism 510 and floor portion 505 of key-holding apparatus 500. Additional detail regarding the operation of tensioning mechanism 510 can be understood by referring to FIG. 7.

Figure 7:
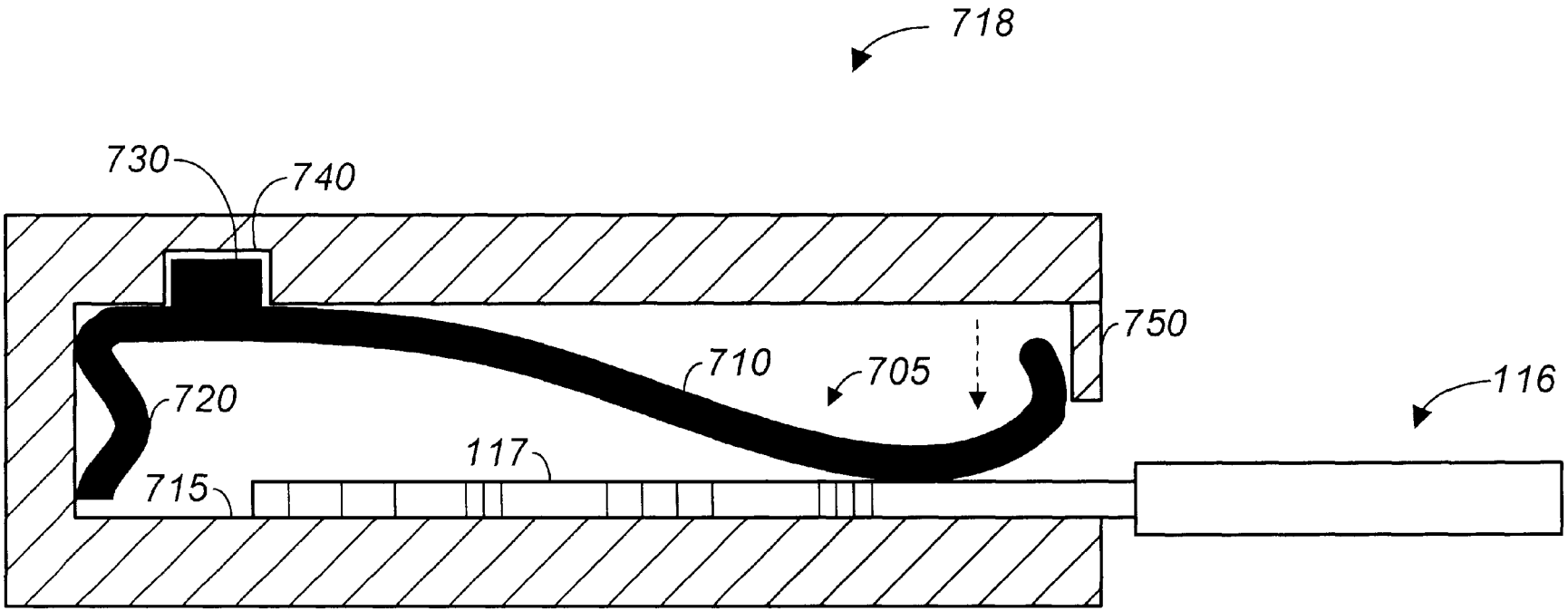
FIG. 7 is an expanded sectional view of a tensioning mechanism for retaining a key within the body of a key-holding apparatus in accordance with a preferred exemplary embodiment of the present invention.

Referring now to FIG. 7, a detailed sectional view of a key receiving portion 718 according to a preferred embodiment of the present invention is shown. Key-receiving portion 718 illustrates the operation of a key-holding apparatus such as key-holding apparatus 500 of FIGS. 5 and 6. Key receiving portion 718 comprises a tensioning mechanism 705, a floor portion 715, a cutout portion 740 and a key blocking portion 750. Tensioning mechanism 705 comprises a pressure portion 710, a rear portion 720, and a locking portion 730. Blocking portion 750 is sized and positioned to prevent shaft portion 117 of key 116 from entering key receiving portion 718 above pressure portion 710, thereby ensuring that shaft portion 117 of key 116 engages pressure portion 710.

Cutout portion 740 is sized and positioned to receive locking portion 730 when tensioning mechanism 705 is inserted into key receiving portion 718. Rear portion 720 is flexible and acts like a spring, allowing tensioning mechanism 705 to slide into key receiving portion 718. Locking portion 730 of tensioning mechanism 705 "snaps" into cutout 740, thereby fixing tensioning mechanism 705 in position inside key receiving portion 718.

Tensioning mechanism 705 is thin, flat, bent, blade-like arm preferably fabricated from a metal or metallic substance that is relatively resilient and is inserted into key receiving portion 718 so that locking portion 730 engages cutout 740. Pressure portion 710 of tensioning mechanism 705 is fabricated to press against floor portion 715 of key receiving portion 718. Accordingly, when shaft portion 117 of key 116 is inserted into key receiving portion 718, shaft portion 117 engages pressure portion 710 and is "pinched" between pressure portion 710 and floor portion 715 of key receiving portion 718.

Figure 8:
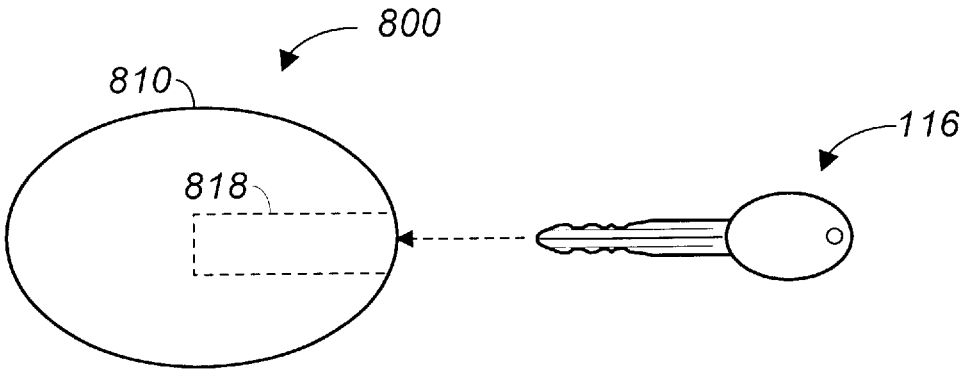
FIG. 8 is a representation of a key-holding apparatus according to a preferred exemplary embodiment of the present invention.

Referring now to FIG. 8, a key-retaining apparatus 800 according to an alternative preferred exemplary embodiment of the present invention is shown. In this embodiment, body portion 810 is substantially oval in shape. Once again, key receiving portion 818 is sized and positioned to receive key 116.

Figure 9:
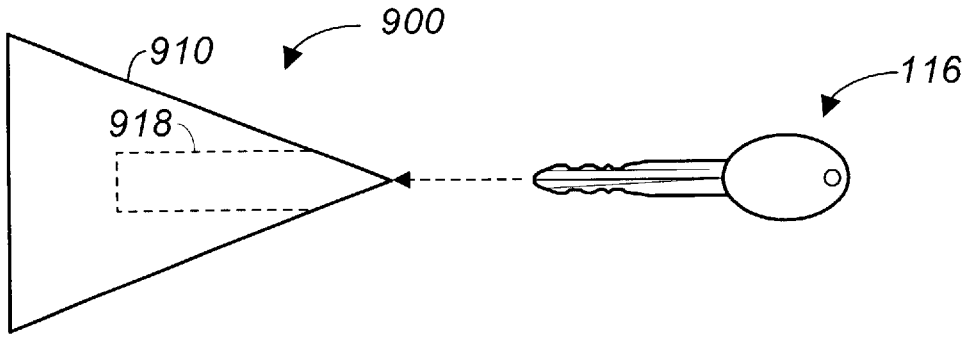
FIG. 9 is a representation of a key-holding apparatus according to a preferred exemplary embodiment of the present invention.

Referring now to FIG. 9, a key-retaining apparatus 900 according to an alternative preferred exemplary embodiment of the present invention is shown. In this embodiment, body portion 910 is substantially triangular in shape. Once again, key receiving portion 918 is sized and positioned to receive key 116.

Figure 10:
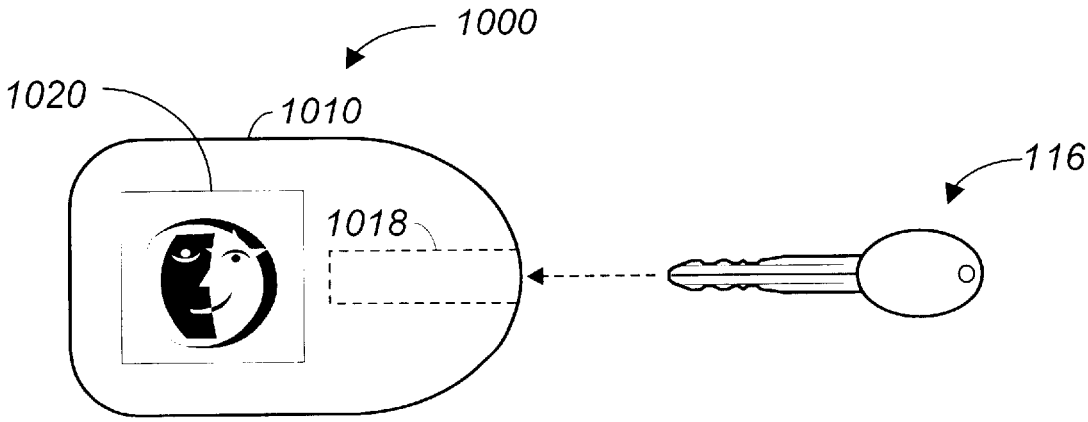
FIG. 10 is a representation of a key-holding apparatus according to a preferred exemplary embodiment of the present invention.

Referring now to FIG. 10, a key-retaining apparatus 1000 according to an alternative preferred exemplary embodiment of the present invention is shown. In this embodiment, body portion 1010 has a generally rectangular shape with a rounded end. Once again, key receiving portion 1018 is sized and positioned to receive key 116. Additionally, a branding location 1020 is provided on body portion 1010. Branding location 1020 is used to provide various indicia, including advertising messages and product or company logos.

Figure 11:
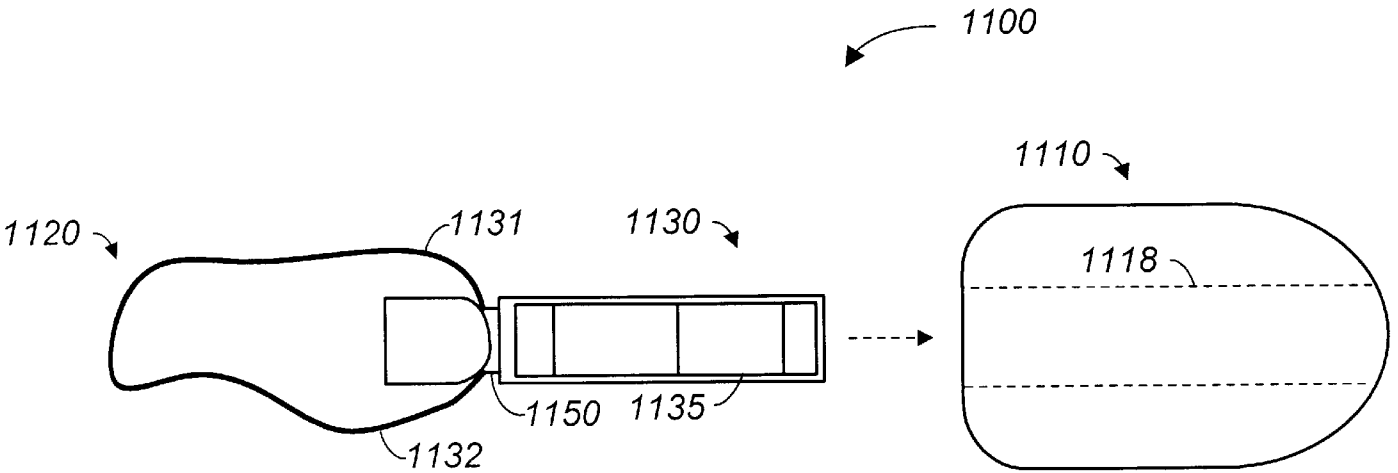
FIG. 11 is an exploded view of a key-holding apparatus according to an alternative preferred exemplary embodiment of the present invention.

Referring now to FIG. 11, a top view of a key-retaining apparatus 1100 according to an alternative preferred exemplary embodiment of the present invention is shown. Key-retaining apparatus 1100 comprises a body portion 1110 and an insert portion 1130. Body portion 1110 comprises a cavity portion 1118. Body portion 1110 is preferably manufactured as a durable one-piece molded plastic device. Insert portion 1130 is designed to fit snugly into cavity portion 1118 and "snap" into place. This can be accomplished by a variety of means well known to those skilled in the art. This includes the use of locking tabs and insets, pressure fitting, etc.

Insert portion 1130 comprises a tensioning mechanism 1135, a strap 1120, and a strap-retaining portion 1150. Strap 1120 comprises a first end 1131 and a second end 1132. Strap-retaining portion 1150 is an indentation in the body of insert portion 1130 that is designed to receive first end 1131 and second end 1132 of strap 1120. Then, when insert portion 1130 is inserted into body portion 1110 of key-retaining apparatus 1100, receive first end 1131 and second end 1132 of strap 1120 are trapped by the sidewalls formed by cavity portion 1118 and are effectively "pinched" in place. This prevents first end 1131 and second end 1132 of strap 1120 from being separated from body portion 1110 of key-retaining apparatus 1100.

Figure 12:
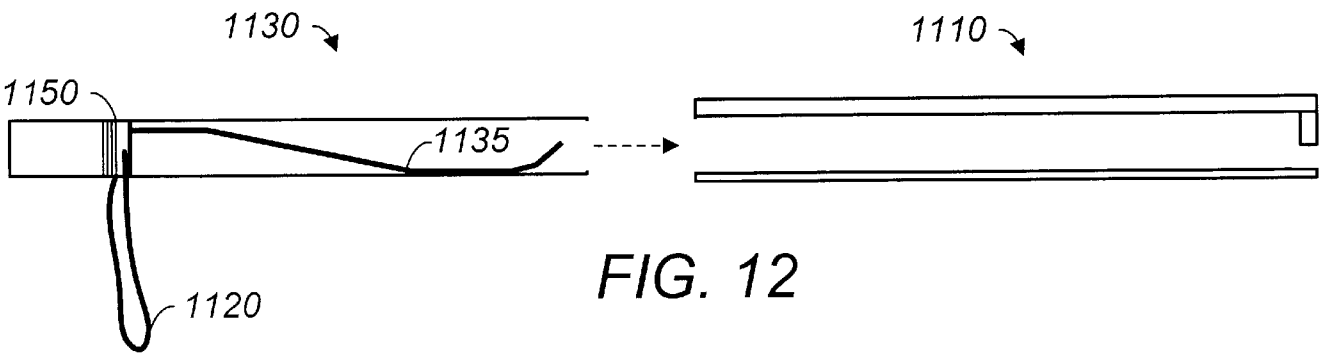
FIG. 12 is an alternative view of the key-holding apparatus of FIG. 11.

Referring now to FIG. 12, a side view of key-retaining apparatus 1100 of FIG. 12 is shown. Strap 1120 is shown with first end 1131 and second end 1132 in strap-retaining portion 1150 and insert portion 1130 is ready to be inserted into body portion 1120. Once fully assembled, key-retaining apparatus 1100 performs in much the same manner as described in conjunction with the previously discussed FIGs.

While the preferred exemplary embodiments have been presented in the foregoing detailed description, it should be appreciated that a vast number of variations exist. It should also be appreciated that the preferred embodiments presented herein are only examples and are not intended to limit the scope, applicability, or configuration of the invention in any way. Rather, the foregoing detailed descriptions provide those skilled in the art with a convenient roadmap for implementing the preferred exemplary embodiments of the present invention. It should be understood that various changes may be made in the function and arrangement of elements described in the exemplary preferred embodiments without departing from the spirit and scope of the invention as set forth in the appended claims.

What is claimed is:

1. An apparatus comprising:

a strap, said strap comprising a first end and a second end;

a body portion, said body portion sad defining a key-receiving aperture, said body portion comprising at least a first sidewall and a second sidewall;

a tensioning mechanism contained within said body portion, said tensioning mechanism comprising a strap-retaining portion, said strap-retaining portion being configured to receive said first end and said second end of said strap; and wherein said first end and said second end of said strap are inserted into said strap-retaining portion and fixed in position within said body portion, with said first end being positioned between said strap-retaining portion and said first sidewall and said second end being positioned between said strap-retaining portion and said second sidewall.

2. The apparatus of claim 1 wherein said tensioning mechanism comprises a spring-loaded ball bearing.

3. The apparatus of claim 1 wherein said tensioning mechanism comprises a thin, flat, bent, blade-like arm.

4. The apparatus of claim 1 wherein said body portion comprises a substantially rectangular body portion.

5. The apparatus of claim 1 wherein said body portion comprises a substantially oval body portion.

6. The apparatus of claim 1 further comprising a key blocking portion, said key blocking portion blocking at least a portion of said key-receiving aperture.

7. The apparatus of claim 1, wherein said body portion further defines a body aperture, said body aperture receiving a restraining strap.

8. The apparatus of claim 1, further comprising:

a floor portion contained within said body portion;

wherein said tensioning mechanism comprises a thin, flat, bent, blade-like arm; and wherein at least a portion of said tensioning mechanism presses against said floor portion.

9. The apparatus of claim 8, further comprising a key with a shaft portion wherein said shaft portion is inserted through key-receiving aperture and is positioned between said tensioning mechanism and said floor portion.

10. A method comprising the steps of:

inserting a key into a key-retaining apparatus, said key comprising a shaft, said key-retaining apparatus comprising:

a strap, said strap comprising a first end and a second end;

a body portion, said body portion comprising at least a first sidewall and a second sidewall;

an insert portion, said insert portion comprising a strap-retaining portion, said strap-retaining portion being configured to receive said first end and a second end of said strap, said first end and said second end of said strap being inserted into said strap-retaining portion and being fixed in position within said body portion, with said first end being positioned between said strap-retaining portion and said first sidewall and said second end being positioned between said strap-retaining portion and said second sidewall; and engaging a tensioning mechanism housed contained within said key-retaining apparatus with at least a portion of said shaft.

11. The method of claim 10 wherein said tensioning mechanism comprises a spring-loaded ball bearing.

12. The method of claim 10 wherein said tensioning mechanism comprises a thin, flat, bent, blade-like arm, wherein at least a portion of said tensioning mechanism contacts a floor portion of said key-retaining apparatus.

13. The method of claim 10 wherein said body portion further comprises a branding location.

14. The method of claim 10 wherein said body portion comprises a substantially rectangular body portion.

15. The method of claim 10 further comprising the step of attaching said key-retaining apparatus to a purse.

16. A key-retaining apparatus, said key-retaining apparatus comprising:

a body portion, said body portion comprising:

at least a first sidewall contained within said body portion;

at least a second sidewall contained within said body portion;

a floor portion contained within said body portion; and a tensioning mechanism contained within said body portion, said tensioning mechanism comprising a thin, flat, blade-like arm, wherein at least a portion of said tensioning mechanism presses against said floor portion;

a strap-retaining portion contained within said body portion;

a strap, said strap comprising a first end and a second end, wherein said first end and said second end of said strap are inserted into said strap-retaining portion and fixed in position within said body portion, with said first end being positioned between said strap-retaining portion and said first sidewall and said second end being positioned between said strap-retaining portion and said second sidewall;

a key-receiving aperture defined by said body portion;

a key blocking portion, said key blocking portion blocking at least a portion of said key-receiving aperture; and a key inserted into said key-receiving aperture, said key comprising a shaft wherein said shaft engages said tensioning mechanism and said shaft is fixed in position between said floor portion and said at least a portion of said tensioning mechanism.

17. The key-retaining apparatus of claim 16 wherein said body portion comprises a substantially oval body portion.

18. The key-retaining apparatus of claim 16 wherein said body portion comprises a substantially triangular body portion.

19. The key-retaining apparatus of claim 16 further comprising a branding location.

* * * * *